United States Patent [19]

Nesse

[11] Patent Number: 4,874,355

[45] Date of Patent: Oct. 17, 1989

[54] METHOD IN THE PRODUCTION OF A CONTAINER, OR A CONTAINER BLANK, RESPECTIVELY, AND A DEVICE FOR USE WITH SAID METHOD

[75] Inventor: Knut O. Nesse, Terneuzen, Netherlands

[73] Assignee: Elopak Systems AG, Glattbrugg, Switzerland

[21] Appl. No.: 174,869

[22] Filed: Mar. 29, 1988

[30] Foreign Application Priority Data

Apr. 6, 1987 [NO] Norway ..... 871430

[51] Int. Cl.[4] ..... B31B 3/74

[52] U.S. Cl. ..... 493/148; 493/337; 493/132

[58] Field of Search ..... 493/148, 184, 337, 328, 493/150, 132; 426/329, 324, 131, 398; 220/458; 229/125.42, 137; 206/621.1, 631.3; 427/285, 286, 288

[56] References Cited

U.S. PATENT DOCUMENTS

| | | | |
|---|---|---|---|
| 2,912,908 | 11/1959 | Crane et al. | 493/132 |
| 3,756,842 | 9/1973 | Megers et al. | 427/288 |
| 4,091,954 | 5/1978 | Wallace | 426/398 |

FOREIGN PATENT DOCUMENTS

| | | | |
|---|---|---|---|
| 48410 | 10/1984 | Japan | 493/148 |
| 87014296 | 3/1987 | Sweden . | |
| 2146624 | 9/1984 | United Kingdom . | |

*Primary Examiner*—Frederick R. Schmidt
*Assistant Examiner*—Jack Lavinder
*Attorney, Agent, or Firm*—Cushman, Darby & Cushman

[57] ABSTRACT

In order to avoid foaming which may influence the closing zone of containers for products of the kind that may foam during the filling procedure, a method is provided according to which an anti-foam medium in the shape of a thin surface layer is applied in the closing area of the container, or container blank, resp., if desired, close to said area on the inner surface of the container. Such application is preferably carried out before the blank is set up as a container. A device for use in the method may comprise a roll (12) provided with one or a number of grooved zones (9',10'). Roll (12) is mounted on a shaft (13) to be rolled in contact with the inner surface of a web (11) from which the container blanks are manufactured, preferably while said web is advanced past roll (12).

5 Claims, 1 Drawing Sheet

Figure 1:
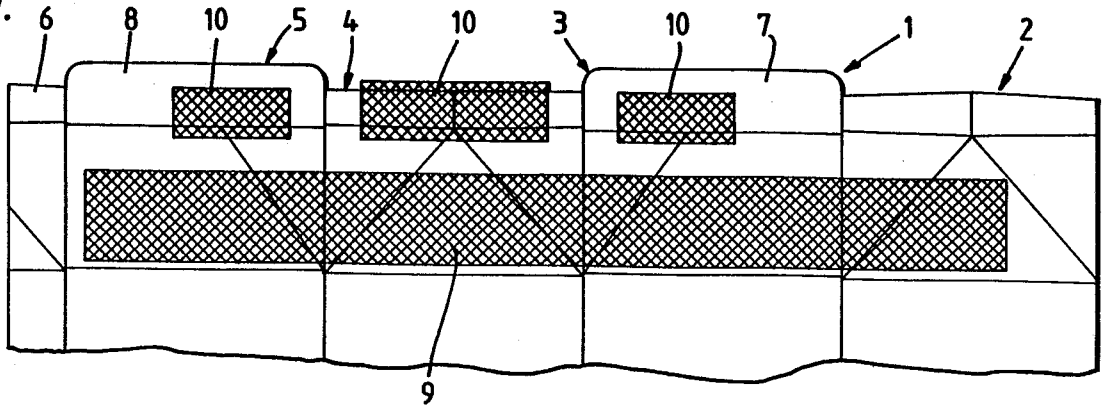

METHOD IN THE PRODUCTION OF A CONTAINER, OR A CONTAINER BLANK, RESPECTIVELY, AND A DEVICE FOR USE WITH SAID METHOD

The invention relates to a method in the production of a container, or a container blank, respectively, which container or container blank is manufactured from a cardboard material coated with an impregnating layer which is suitable for the product, which container is provided with a closing area, comprising a sealing zone for fluid tight sealing of the container, and which container is filled with a product that may foam during the filling process, before and possibly after sealing. The invention also relates to a device for use in the production of such containers or container blanks.

When containers are filled with fluid products, e.g. milk, juice, and the like in filling plants problems often arise due to the fact that the product foams during the filling process. This is a problem of which consumers are not aware, since milk and this kind of products are not considered as foaming. When such a product is introduced at comparatively high speed into a cardboard container in a filling machine, however, a marked foaming process occurs, although it is not long-lasting. The foam will follow the liquid level and it will cause deposition of moisture in the closing and sealing area which may, in turn, cause difficulties in achieving a satisfactory seal.

In order to eliminate such problems methods were developed to raise the filling nozzle upwards successively while the container is filled, or to lower the container in order to achieve the same effect. All such methods, however, result in a considerably more complicated filling equipment, and they do not always ensure the desired result. Another approach to avoid foaming is, obviously, to reduce filling speed, but this is inefficient as regards utilization of the plant. It is, furthermore, possible to provide a suction nozzle in the upper area of the containers enabling the foam to be sucked off the liquid surface. This approach is also not very suitable since the foam removed by suction is part of the product, even though a small part, which has to be disposed of. Also the suction device constitutes additional equipment and must be maintained in a sterile state.

It is, thus, an object of the present invention to provide a solution to the above mentioned problem which does not involve complications of the above mentioned kind as regards the filling plant, and which ensures good sealing at the same time as the container may readily be opened.

This object is achieved by a method and a device characterized by the features appearing in the claims.

According to the invention an antifoam medium is applied in a thin surface layer on the inside of the container wall in an area that may be considered a barrier to the sealing zone. As regards production technique it would be most advantageous to apply said layer on the container blank during manufacture of the blanks and before the blank is set up as a container. This barrier of antifoam medium will cause foam to break down in the closing area of the container to prevent foam from influencing the seal. The method constitutes treatment of the container proper or the container blank, i.e. no special structure of the filling apparatus is required, and the method may be utilized in connection with all existing plants. Said layer is preferably applied in a liquid state with a rapidly evaporating solvent. Even though it is, obviously, possible to apply the medium in many different manners, also after the blank is set up in the shape of a container, it will indeed be most advantageous to apply the antifoam medium already during manufacture of the container blank, since it may then be spread on or applied in a simple manner in the desired areas and the desired zones. For such a mode of application, e.g. a coating roll may be used and rolled in contact with the web of container blanks before said blanks are provided with folding lines and before cutting so that the medium is dried when the blank is completed and permits storage.

The term closing area indicates the upper portion of the container which will commonly extend above the liquid level when the container is filled. In a container comprising a gable-shaped top portion the closing area will consist of the gable-shaped portion with the sealing flap constituting the sealing zone. In a container comprising a flat top the end face with the folding area will constitute the closing area. The sealing zone is the zone where actual sealing is carried out.

Figure 2:
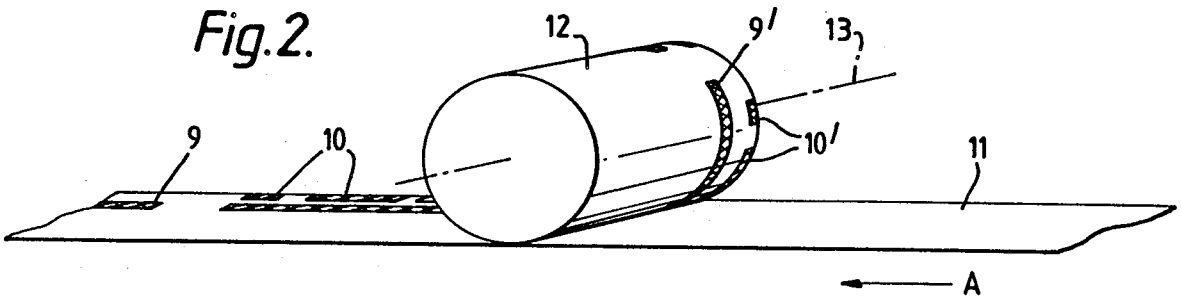

The invention will be disclosed in more detail below with reference to an embodiment illustrated in the drawing which shows:

FIG. 1 the upper portion of a cardboard container blank after utilization of the method according to the invention, and FIG. 2 diagrammatically device according to the invention.

In FIG. 1 of the drawing the upper portion of a blank for a cardboard container intended for milk, juice, or the like is illustrated, said container being of the kind with a gable-shaped top comprising a sealing flap which projects upwards. The container blank is designated 1 in FIG. 1 and it is constructed in a known manner by four side faces 2, 3, 4, and 5, and a flap 6 for joining by welding. The manufacture and procedure for setting up the blank to a container are well known. By the aid of the method according to the invention an antifoam medium is applied in the shape of a thin surface layer adjacent to and/or in the closing area on the inside of the container. In the embodiment shown in FIG. 1 said surface layer consists of a strip shaped zone area which is designated 9. Additionally, three upper zones 10 are shown which are placed in the sealing area. All these areas are cross-hatched in the Figure. As will appear from the drawing areas 9 and 10 are situated in the portion of the blank which is designed to form the gable-shaped top portion to be closed. The antifoam medium is applied to the continuous and wider zone 9 on an oblique face, whereas a silicon is applied to zones 10 to facilitate subsequent opening of the container. However, an antifoam medium may also be applied to all four zones 10 in the sealing area proper and closely beneath said area, since two of said zones are continuous on the blank. There will, thus, be an antifoam layer in the sealing zone proper as well, which proved to be suitable. A number of different kinds of antifoam mediums may be used, but it is important in this connection that a rapidly drying medium is used. For this reason a rapidly evaporating solvent is added to the antifoam medium to cause the latter to crystallize after evaporation. A mixture of water and an organic solvent is preferred in the solvent, and an especially suitable organic solvent is ethanol. Especially suitable antifoam compositions are disclosed in the contemporary Swedish Patent Application No.

8701429-6 filed by Berol Kemi AB. The antifoam compositions are insoluble in water. An example is a composition having a molecule weight of 400–10000, preferably 1000–6000, with at least 40 percents by weight consisting of alkylene oxi groups having 2–4 carbon atoms of which at least 60% consist of alkylene oxy groups having 3–4 carbon atoms.

The antifoam medium is, preferably, applied by the aid of a coating roll which is rolled over the container blank. On said roll there are zones of a desired length and size which are shaped as ribbon areas or stamped areas. At present, areas are preferably used which are provided with grooved lines with a V-shape and extending obliquely, as diagrammatically illustrated in FIG. 1 by shaded areas, but several modifications are possible. If the medium is applied after the blank was set up as a container the medium may, e.g. be applied by the aid of a brush or are pressure plunger. In that case it is, however, difficult to ensure accurate application as regards volume, and application on the blank proper is, thus, preferred.

FIG. 2 illustrates the device used in the most preferred method of application, i.e. application on the container blank during its manufacture. The cardboard material is advanced in webs 11 through a production plant for container blanks. In the first section of said plant a cylinder 12 is provided to rotate about an axis 13 so that roll 12 is rolled in contact with web material 11. In suitable areas on the roll grooved areas 9', and 10' are provided. These areas correspond to the zones 9 and 10 to be coated with the antifoam layer on blank 1. Areas 9' and 10' are shaped as grooved areas, and in the shown embodiment said grooves extend obliquely relative to the direction of the drum. The grooves have a V-shaped profile and the number and size of grooves is adapted to the volume of medium to be applied to the container blank. The application of the medium on the grooved portions of the roll may be carried out in any suitable manner, e.g. by coating from above by a roll 12 extending across the web, or by placing the roll underneath with its grooved portion immersed in a suitable vessel. The grooves are, thus, filled with an antifoam medium in a solvent, e.g. ethanol which will evaporate rapidly after the medium is applied to the advanced cardboard web, which is advanced in the direction of arrow A. In FIG. 2 application of the desired zones is indicated on the left side of roll 12.

In order to illustrate that this is a question of very thin applications, it may be mentioned that, e.g. 0.3 ml of anti-foam medium in a dissolved state is to be applied to each blank. Approximately 50–75% of this will evaporate leaving approximately 0.1–0.15 ml, corresponding to approximately 0.1 g, in crystalline state. Using a density of grooves corresponding to 80 lines per 2.5 cm in the grooved portions on roll 12, and with a triangular shape of grooves having a width of 0.16 mm and a depth of 0.07 mm it will be possible to apply 17.5 ml antifoam medium per $m^2$. The size of the surface is 62.5 $cm^2$. The medium will dry very rapidly by evaporation of the solvent, e.g. ethanol, and a drying period of approximately 5 sec. is considered suitable. In the course of this period the web will be advanced to the equipment forming the folding lines, and the cutting equipment, and the antifoam medium will, thus, be present in a solid state at the time when the container blank is completed. The blanks may be stored in this shape or they may be used immediately.

It should be mentioned that only the principles of the simplest possible design of a device for application are illustrated above, a number of modifications being possible as regards design, arrangement, density, etc. of grooves. Those values have to be adapted to the utilized antifoam medium, and the desired thickness of the layer to be achieved which will, in turn, depend on the concentration of the antifoam medium. As mentioned above, it will also be possible to apply the medium in other manners than by the aid of an application roll. It is also possible to use etched plates in stead of grooved ones.

I claim:

1. A method of producing a container of the type where the container is to be filled with a product that may foam during filling or sealing comprising:

(a) providing a blank cardboard material coated with an impregnated layer suitable for the product to be contained and with the blank having a sealing zone for forming a sealed closure upon forming the blank into a container and another zone adjacent to but spaced from said sealing zone so that, when the blank is formed into a container, said another zone will be located interiorly with respect to said sealing zone, (b) applying an antifoam medium in the form of a narrow strip to said another zone spaced from said sealing zone by means of roll with said medium containing a composition not soluble in water and having a molecular weight of between 400–10,000 with at least 40% by weight consisting of alkylene oxy groups with 2-4 carbon atoms and of which at least 60% consist of alkylene oxy groups with 3-4 carbon atoms, and (c) shaping the blank into a container so that upon filling, any foam generated will first contact said another zone prior to contacting said sealing zone.

2. A method as defined in claim 1, including the step of applying said antifoam layer as a liquid with a rapid drying solvent and solidifying said liquid before the blank is set up as a container.

3. A method as defined in claim 2 including using a mixture of water and ethanol for the solvent.

4. A method as defined in claim 1 or 2, including applying the antifoam medium under pressure from a roll having recesses formed in zones thereon.

5. A method as defined in claim 1, including also applying the antifoam medium in the sealing zone.

* * * * *